US005390459A

United States Patent [19]

Mensen

[11] Patent Number: 5,390,459

[45] Date of Patent: Feb. 21, 1995

[54] CONCRETE FORM WALLS

[75] Inventor: Jan H. Mensen, Coubourg, Canada

[73] Assignee: AAB Building System Inc., Ottowa, Canada

[21] Appl. No.: 41,412

[22] Filed: Mar. 31, 1993

[51] Int. Cl.[6] ..... E04B 2/00

[52] U.S. Cl. ..... 52/426; 52/424

[58] Field of Search ..... 57/424, 426, 562, 565, 57/564, 580, 699, 700, 712, 563

[56] References Cited

U.S. PATENT DOCUMENTS

| | | | |
|---|---|---|---|
| 3,286,428 | 11/1966 | Kay | 52/562 |
| 4,698,947 | 10/1987 | McKay | 52/426 X |
| 4,730,422 | 3/1988 | Young | 52/562 X |
| 4,879,855 | 11/1989 | Berrenberg | 52/426 X |
| 4,884,382 | 12/1989 | Horobin | 52/426 |

FOREIGN PATENT DOCUMENTS

| | | |
|---|---|---|
| 826584 | 11/1969 | Canada . |
| 1145584 | 5/1983 | Canada . |
| 1154278 | 9/1983 | Canada . |
| 1182304 | 2/1985 | Canada . |
| 1194706 | 10/1985 | Canada . |
| 1209364 | 8/1986 | Canada . |
| 1233042 | 2/1988 | Canada . |
| 1234701 | 4/1988 | Canada . |
| 1244668 | 11/1989 | Canada . |
| 1303377 | 6/1992 | Canada . |
| 1304952 | 7/1992 | Canada . |

OTHER PUBLICATIONS

Brochure "The Ice Block"; W.A.M. Inc., 206 South Main, Maquoketa, Iowa 52060.

Brochure "Consulwal"; Consulwal, 2668 Mt. Albert Rd. E., R.R. #1, Queensville, Ontario, Canada, L0G 1R0.

*Primary Examiner*—Carl D. Friedman

*Assistant Examiner*—Creighton Smith

*Attorney, Agent, or Firm*—Howrey & Simon

[57] ABSTRACT

The invention provides a building component comprising first and second high density foam panels each having inner and outer surfaces, top and bottom, and first and second ends, the panels arranged in spaced parallel relationship with their inner surfaces facing each other, and at least two bridging members extending between and through and molded into the panel members, each bridging member comprising a pair of elongated end plates oriented in the top to bottom direction of the panels and abutting against the outer surfaces of the panels, and at least one web member extending between and rigidly connected to the end plates, each web member oriented in the top to bottom direction of the panels and having a height substantially less than the height of the panels.

33 Claims, 6 Drawing Sheets

CONCRETE FORM WALLS

This application relates to a building component of the type which is used to build up permanent concrete form walls in building construction.

BACKGROUND OF THE INVENTION

In conventional construction in North America concrete walls are normally produced by constructing form walls, pouring concrete into the space between the walls and, upon the setting of the concrete, removing the walls. Finishing materials are then added to the concrete walls as required.

Typically in residential construction, concrete basement walls will be constructed in the manner discussed above and wood framing will be constructed on top of the basement walls. Insulation will be inserted between the framing members and the wall finished inside and out as desired.

Clearly both parts of this construction are inefficient. With respect to the concrete basement walls, it is time-consuming and wasteful of materials to have to remove the form walls after the basement walls are poured. Furthermore, it is now common to insulate all basement walls, particularly in colder climates, and framing and insulation must be installed separately inside the walls.

The piecemeal construction which is inherent in the wood frame part of the structure is labour-intensive and expensive.

As a result, there have been ongoing efforts for many, many years to provide more modular types of wall construction from which efficiencies can be gained.

One such construction type is that with which the current invention is concerned.

For some 15 years a system has been in use particularly in Europe which combines a number of the operations normally associated with residential and other building construction to provide savings in materials, energy, etc. The system basically comprises the use of a foam insulating material to construct permanent concrete form walls. The form walls are constructed and the concrete poured and the form walls then left in place. The concrete wall so formed need not be confined to basement walls but may comprise all of a building's walls. No further insulation is necessary, and finishing materials may be applied to the interior and exterior of the wall as required.

Variations on this system have been proposed to achieve various improvements. All of the systems thus far proposed, while in many cases very useful, suffer from some or other disadvantages.

Against this background the present invention provides a building component for use in such a system which when integrated into a wall construction offers advantages over such prior art systems.

PRIOR ART

Applicant is aware of Canadian Patent No. 1,209,364, issued in 1986 to Aregger AG Bauunternehmung. The components described in that patent include cross members, the ends of which are disadvantageously completely embedded in the foam blocks.

BRIEF SUMMARY OF THE INVENTION

It has now been discovered that substantial advantages can be obtained where the building component used to build up a concrete form wall comprises bridging members which extend entirely through the foam blocks to terminate in a plate which abuts the outside surface of the blocks.

Thus, the invention provides a building component comprising first and second high density foam panels each having inner and outer surfaces, top and bottom, and first and second ends, the panels arranged in spaced parallel relationship with their inner surfaces facing each other, and at least two bridging members extending between and through and molded into the panel members, each bridging member comprising a pair of elongated end plates oriented in the top to bottom direction of the panels and abutting against the outer surfaces of the panels, and at least one web member extending between and rigidly connected to the end plates, each web member oriented in the top to bottom direction of the panels and having a height substantially less than the height of the panels.

BRIEF DESCRIPTION OF THE DRAWINGS

In drawings which illustrate embodiments of the invention.

Figure 1:
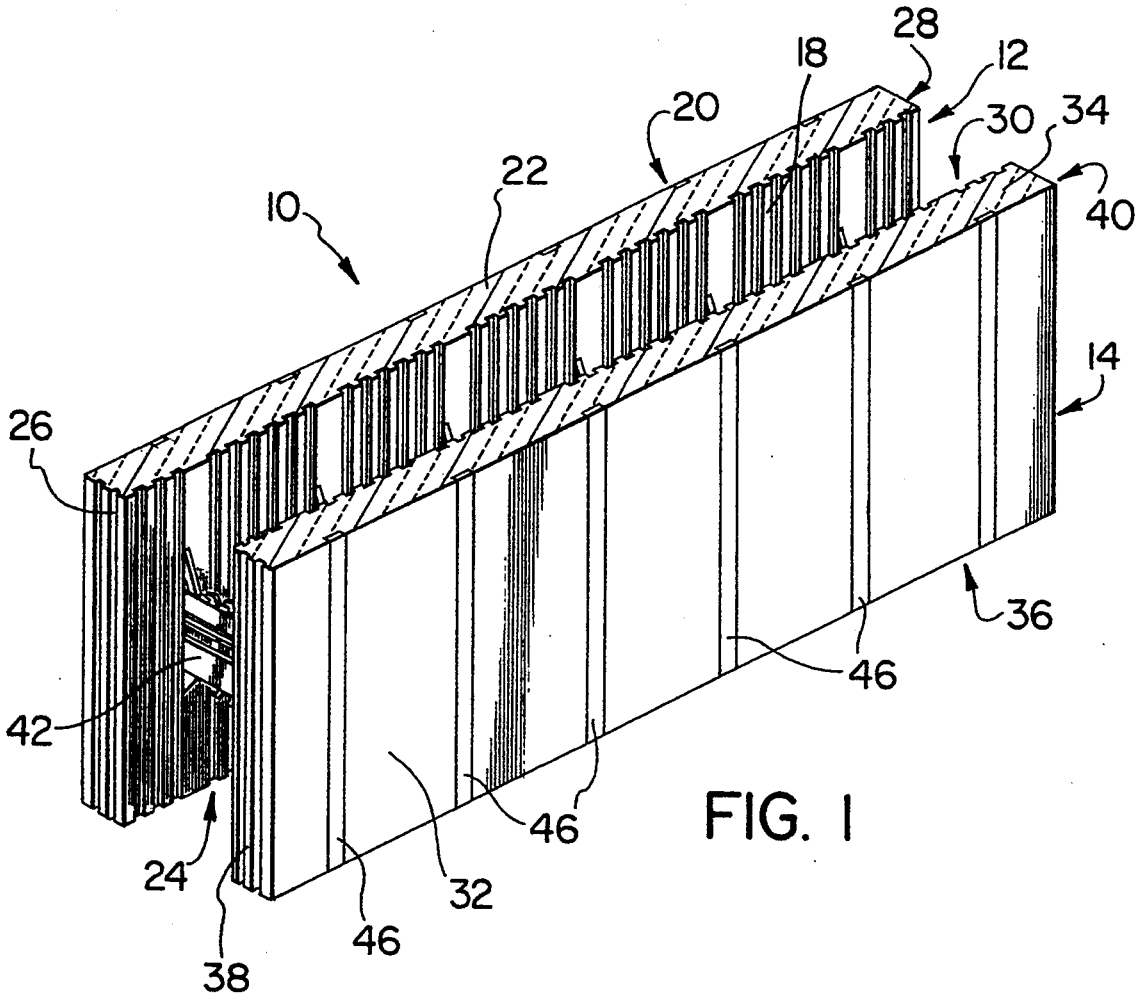
FIG. 1 is a perspective view of a building component according to the invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

The building component 10 comprises first and second foam panels 12 and 14 secured together by at least two bridging members 42.

Panel 12 comprises inner and outer surfaces 18 and 20 respectively, top and bottom 22 and 24 respectively, and first and second ends 26 and 28. Panel 14 comprises inner and outer surfaces 30 and 32, top and bottom 34 and 36, and first and second ends 38 and 40.

The panels 12 and 14 are preferably expanded polystyrene. Subject to indentations and protrusions of minor height to be discussed below, the panels are of uniform rectangular cross-section. In a typical case each panel may be 48 inches long, 16 $\frac{3}{4}$ inches high and 2 $\frac{5}{8}$ inches thick.

Figure 3:
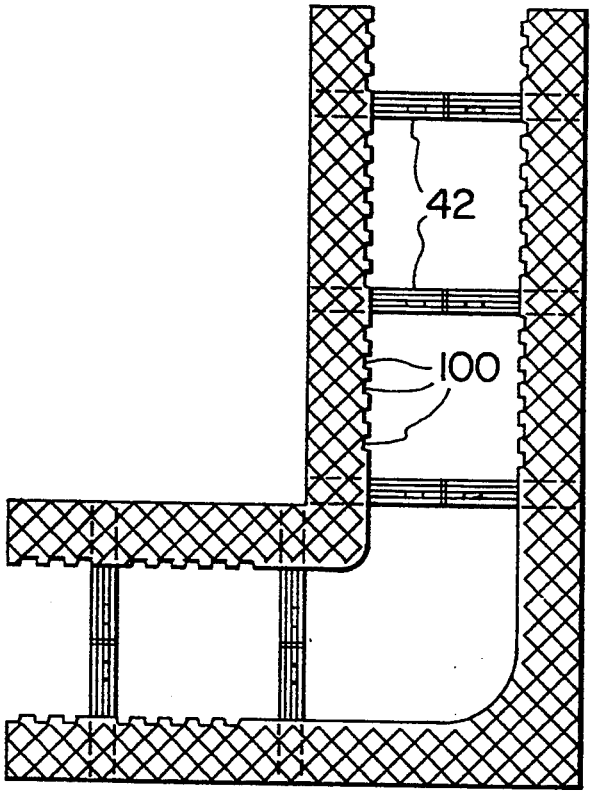
FIG. 3 is a top plan view of another embodiment of the building component according to the invention.
Figure 4:
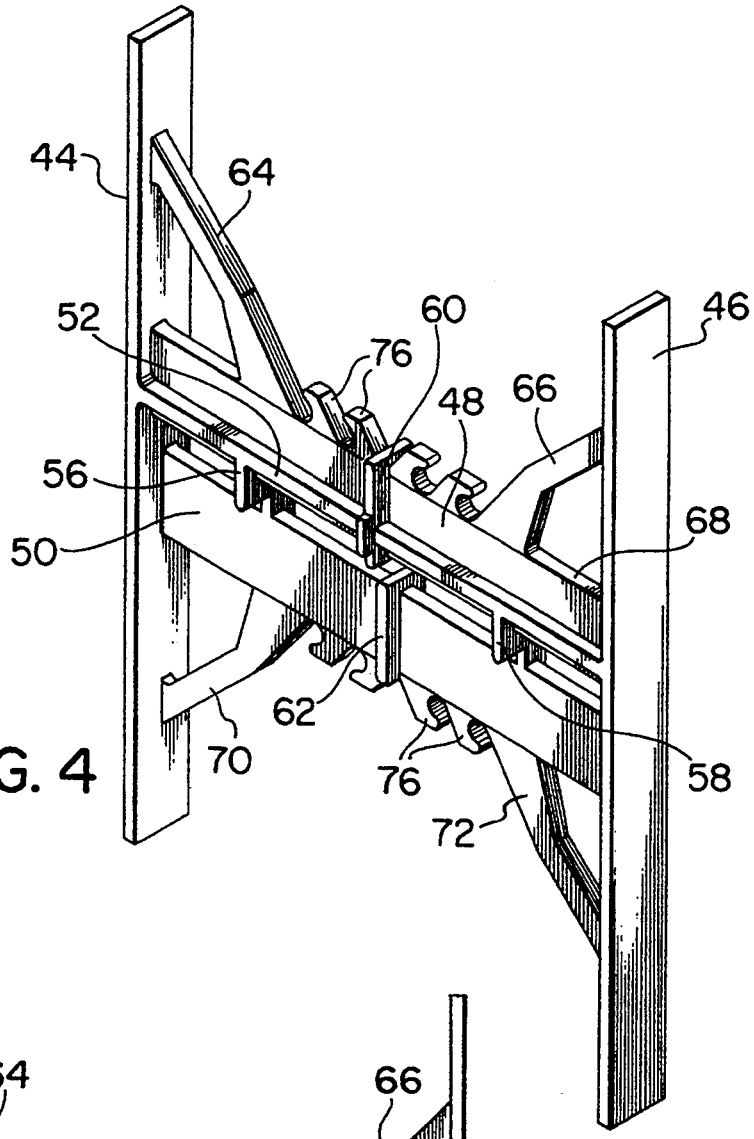
FIG. 4 is a perspective view of a bridging member for use in the invention.
Figure 5:
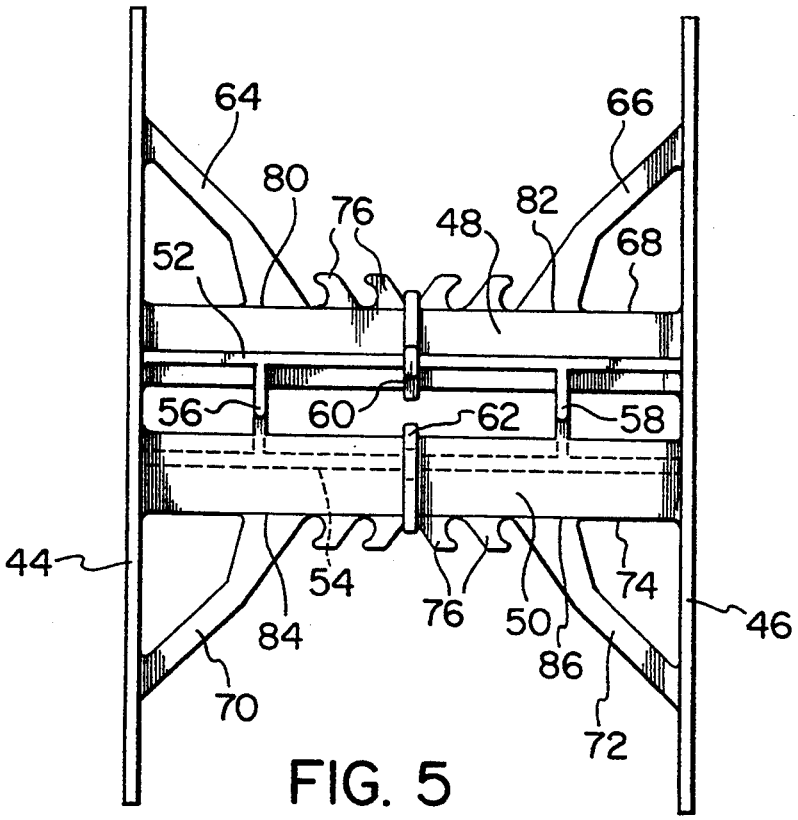
FIG. 5 is a side view of the bridging member of FIG. 4.

As indicated in FIG. 3, panels 12*a* and 14*a* may be modified for specific purposes. The FIG. 3 embodiment illustrates a corner section.

Bridging members 42 comprise a pair of elongated end plates 44 and 46 joined by at least one web member 48. In the preferred configuration bridging members 42 each comprise a pair of web members 48 and 50.

Figure 7:
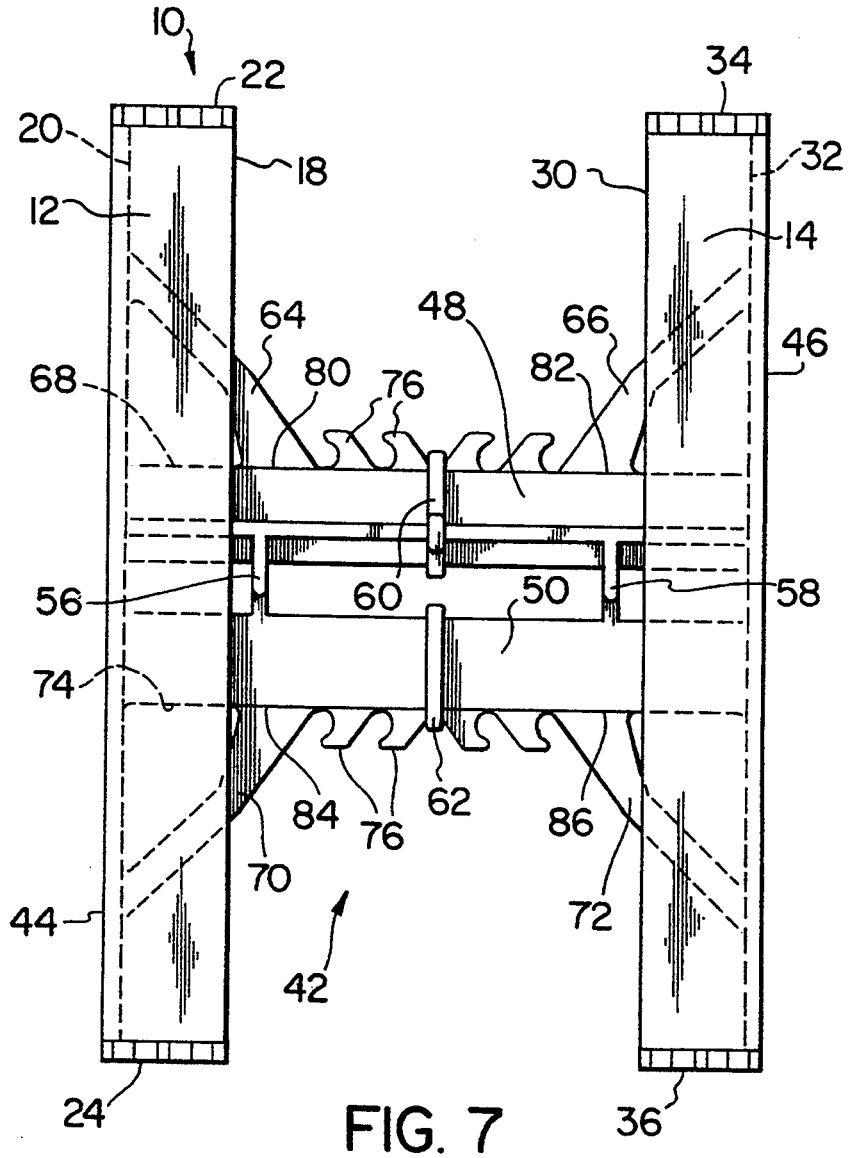
FIG. 7 is an end view of a building component according to the invention incorporating the bridging member of FIG. 4.

As illustrated, for example, in FIG. 1, the end plates 44 and 46 abut against the outer surfaces 20 and 32 of panels 12 and 14 respectively. As best illustrated in FIG. 7, end plates 44 and 46 are preferably recessed into surfaces 20 and 32 and are substantially flush with those surfaces. End plates 44 and 46 are preferably oriented in the top to bottom direction of panels 12 and 14. In the normal position of use, this is the vertical direction.

Figure 6:
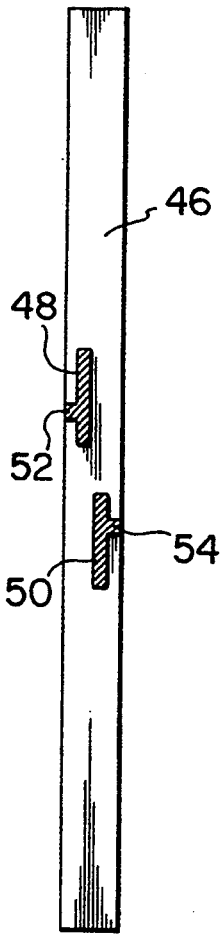
FIG. 6 is an end view of the bridging member of FIG. 4.

In the preferred configuration of bridging members 42, as best illustrated in end view in FIG. 6, web members 48 and 50 are offset relative to each other in the top to bottom direction and in the first end to second end direction of panels 12 and 14. In the normal position of use those offsets are respectively in the vertical and horizontal directions.

The web members 48 and 50 preferably include reinforcing ribs 52 and 54 extending longitudinally of said web members between end plates 44 and 46. As well, bridging members 42 preferably include reinforcing webs 56 and 58 between web members 48 and 50. Further central reinforcing webs 60 and 62 are preferably provided toward the centre of web members 48 and 50.

In the preferred embodiment reinforcing members 64 and 66 extend from an upper edge 68 of web member 48 to end plates 44 and 46 respectively. Similarly, reinforcing members 70 and 72 extend from lower edge 74 of web member 50 to end plates 44 and 46 respectively.

Figure 12:
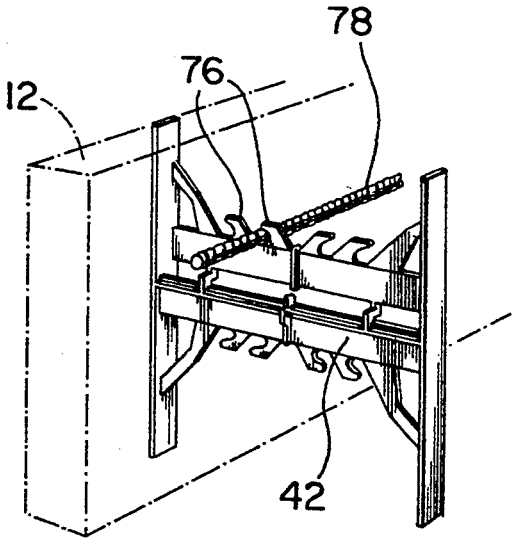
FIG. 12 is a perspective view of a building component according to the invention illustrating the use of rebar.

Finally, the bridging members 42 are preferably provided with a series of hooked structures 76 on upper edge 68 of web member 48 and lower edge 74 of web member 50. These members serve as illustrated in FIG. 12 to support steel reinforcing bars such as rebar 78.

Each bridging member 42 preferably comprises a single integral unit. These members are preferably of plastic. The preferred plastic is high density polyethylene, although polypropylene and other suitable polymers may be used.

The bridging members 42 are molded into the panels 12 and 14 in the course of producing the panels. As best seen in FIG. 7, the end plates 44 and 46 are preferably of substantially equal height to the panels 12 and 14 and are flush with the top and bottom of the panels, subject to the vertical joining means on the panels to be discussed below.

The reinforcing members 64 and 66, and 70 and 72 join their respective webs 48 and 50 at points 80, 82, 84 and 86 respectively, outside of the inner surfaces 18 and 30 respectively of panels 12 and 14.

Figure 10:
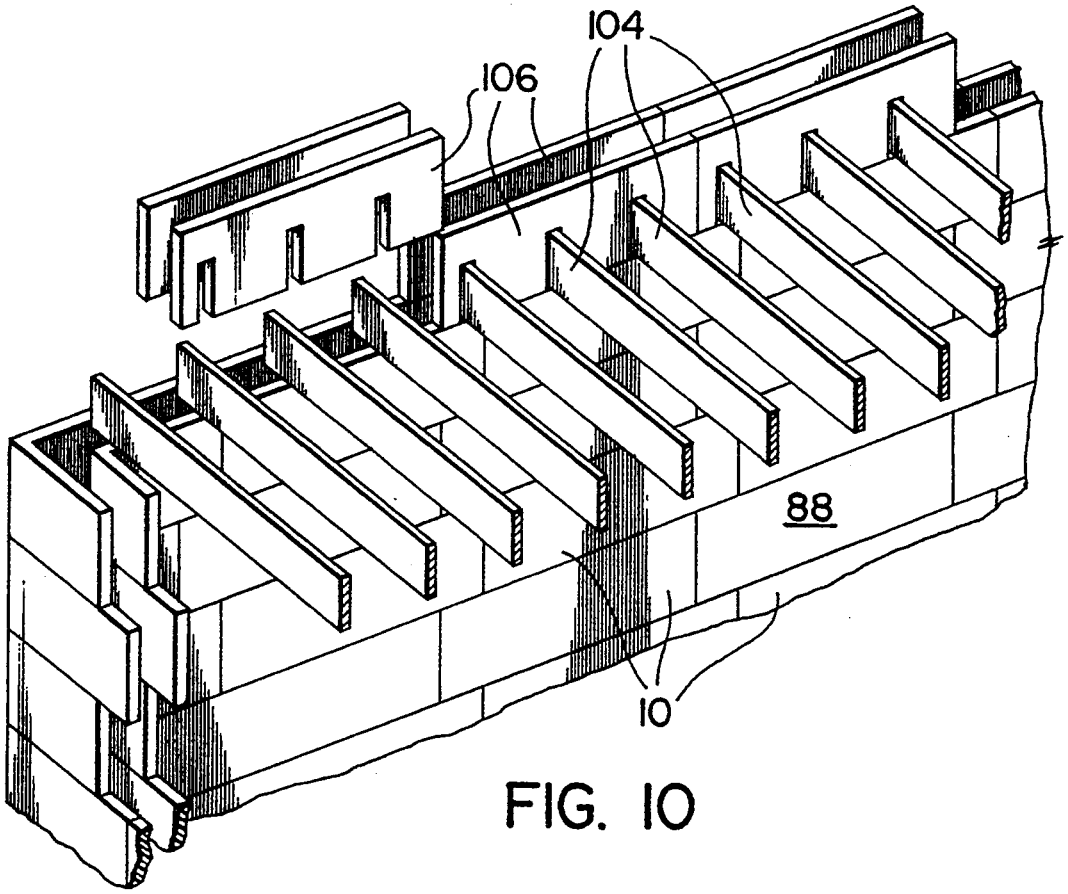
FIG. 10 is a perspective view of a partially constructed wall in accordance with the invention.
Figure 11:
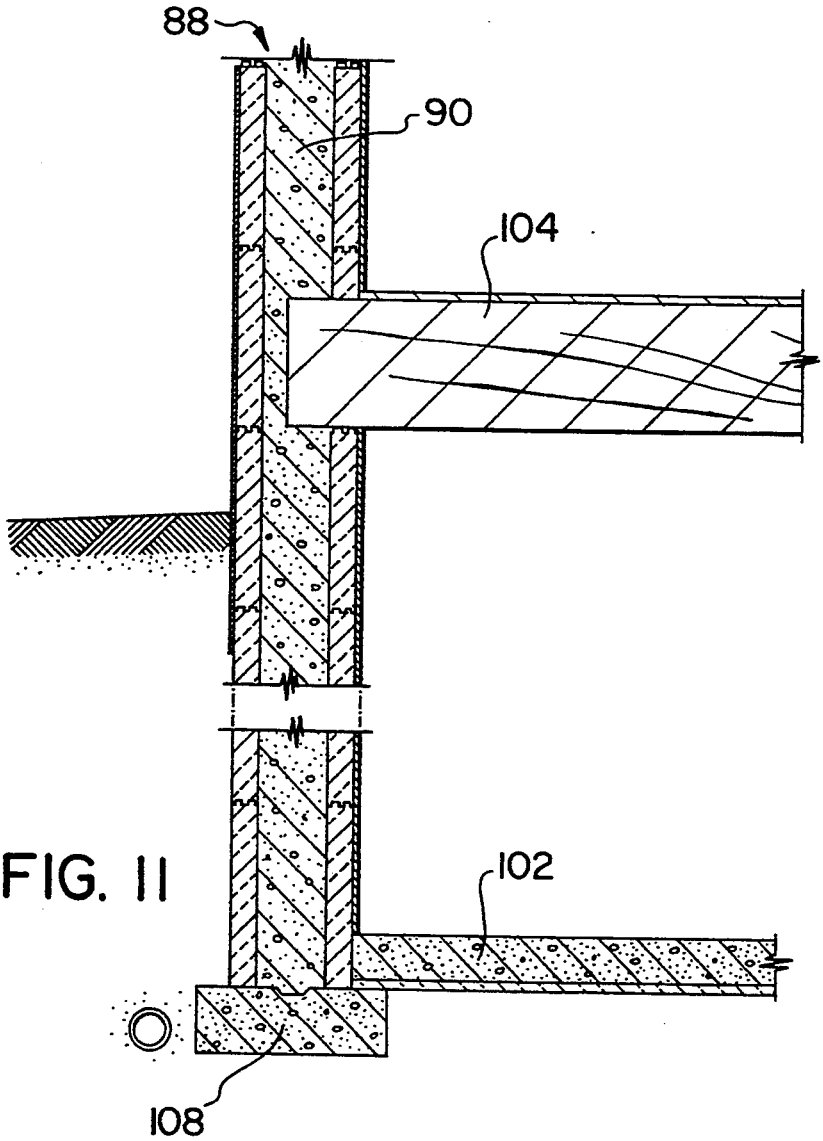
FIG. 11 is a cross-section through a part of a building site including a wall constructed utilizing the building component of the invention.

As illustrated in FIGS. 10 and 11, a series of components 10 are built up to form a wall 88. Initially a series of components 10 are stacked to form a hollow wall or concrete form after which concrete 90 is poured into the hollow part of wall 88 to complete the wall.

Figure 8:
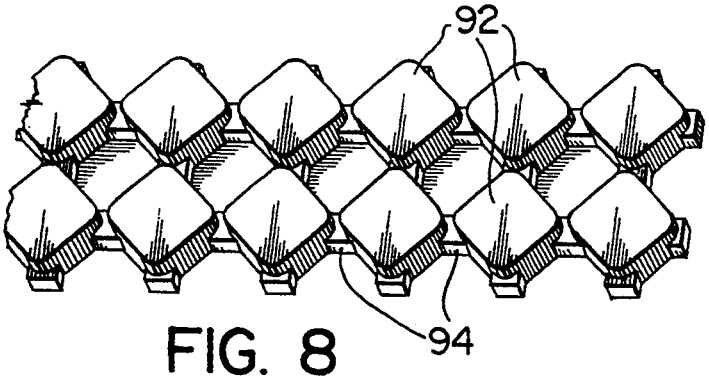
FIG. 8 is a perspective view of a series of protrusions and interconnecting walls for use on the top of a building component according to the invention.
Figure 9:
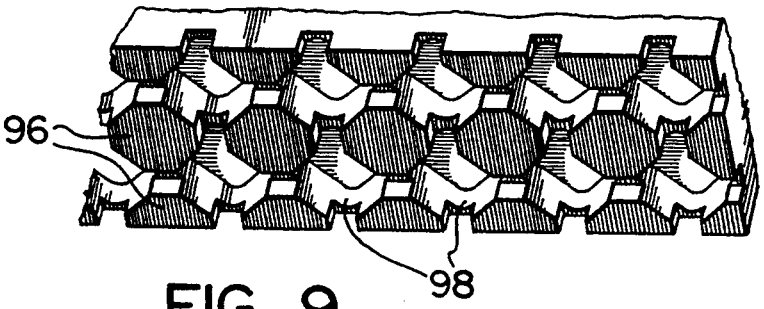
FIG. 9 illustrates a series of protrusions and depressions for use on the bottom of a building component according to the invention.

In order to facilitate the stacking of the components 10, the panels 12 and 14 are provided on the top thereof with a series of plugs 92 joined by low walls 94 (FIG. 8); and on the bottom 24 and 36 thereof with a mating series of plugs 96 and walls 98 (FIG. 9). The plugs 92 and 96 are offset relative to each other, such that when the bottom of one component 10 is placed on the top of a lower component 10, the plugs 92 and walls 94 of the upper component mate with the plugs 96 and walls 98 of the bottom of the upper component to form a tight seal to prevent leakage of concrete during wall formation and of energy through the completed wall.

Figure 2:
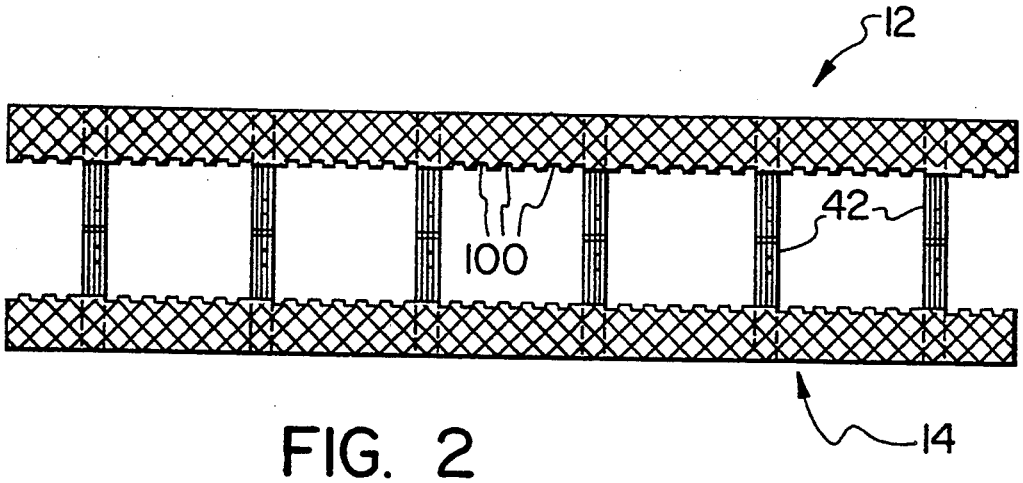
FIG. 2 is a top plan view of a building component according to the invention.

As best illustrated in FIGS. 2 and 3, the inner surfaces 18 and 30 of panels 12 and 14 respectively are preferably provided with a series of indentations 100. Concrete being poured into the hollow wall will flow into indentations 100 and enhance the bond between panels 12 and 14 and concrete 90.

With reference to FIGS. 10 and 11, the manner of adapting the wall to building construction is illustrated. The wall 88 in FIG. 10 can be seen to be constructed from a series of offset components 10. The offset is clearly preferred in order to provide enhanced joint strength. In the typical component discussed earlier, of 48-inch width, the bridging members 42 will preferably be spaced on 8-inch centres with the two bridging members closest to the ends of the component located 4 inches from the ends. Thus, when the panels are overlapped to form the wall, the bridging members of the various courses can be aligned to form continuous strips of end plates 44 and 46 over the entire height of the wall. This is a very significant advantage of the present system, since interior or exterior wall cladding can be fixed to the exterior of the end plates 44 and 46, preferably using screws.

The typical 16 $\frac{3}{4}$ inch height dimension mentioned earlier can be seen to provide a wall height of 8 feet one-half inch when six courses of components 30 are used and taking into account the thickness of the floor 102.

The floor joists 104 can then be laid on top of the sixth course of components 30 and the special configuration 106 of components 30 can then be put in place to continue the wall.

In the typical wall construction of FIG. 11 the wall 88 is built on footing 108. Drainage is provided and parging and damp-proofing of the exterior as is the case with a conventional concrete basement wall.

Using the typical dimensions noted above with a panel separation of 6 $\frac{1}{4}$ inches (6 $\frac{1}{4}$ inches of concrete) the insulating value of the wall is R26. This is a very high rating for wall construction and thus no additional insulation is required. In addition to the energy-saving value of the insulation, the walls have high resistance to sound transmission with a sound reduction of 48DBA.

The typical component noted above will weigh only about 2.8 kgs. and so provides a substantial advantage to tradesman building a wall.

Thus it is apparent that there has been provided in accordance with the invention a building component that fully satisfies the objects, aims and advantages set forth above. While the invention has been described in conjunction with a specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention is:

1. A building component comprising first and second high density foam panels each having inner and outer surfaces, top and bottom, and first and second ends, said panels arranged in spaced parallel relationship with their inner surfaces facing each other, and at least two bridging members extending between and through and molded into said panel members, each said bridging member comprising a pair of elongated end plates oriented in the top to bottom direction of said panels and abutting against said outer surfaces of said panels, said end plates extending substantially from top to bottom of said panels, and at least one web member extending between and rigidly connected to said end plates, each said web member oriented in the top to bottom direction of said panels and having a height substantially less than the height of said panels and substantially less than the height of said end plates.

2. The building component of claim 1 wherein said web members are integral with said end plates.

3. The building component of claim 2 wherein said bridging members are constructed of plastic.

4. The building component of claim 3 wherein said plastic is high density polyethylene.

5. The building component of claim 2 wherein each said bridging member includes two said web members.

6. The building component of claim 5 wherein said two web members are offset from one another in the top to bottom direction of said panels.

7. The building component of claim 5 wherein said two web members are offset from each other in the first to second end direction of said panels.

8. The building component of claim 5 wherein said two web members are offset from one another in the top to bottom and in the first to second side directions of said panels.

9. The building component of claim 8 wherein a lower of said web members includes toward each end thereof a reinforcing member extending from a lower edge of said web member to a respective said end plate, and an upper of said web members includes toward each end thereof a reinforcing member extending from an upper edge of said web member to a respective said end plate.

10. The building component of claim 9 wherein said reinforcing members meet said edges outside of said inner surfaces of said panels.

11. The building component of claim 2 wherein each said web member includes at least one reinforcing rib along a surface thereof between said end plates.

12. The building component of claim 3 wherein each said web member includes at least one reinforcing rib along a surface thereof and wherein said bridging member includes at least one reinforcing structure between said web members.

13. The building component of claim 12 wherein said reinforcing structure comprises a rib.

14. The building component of claim 2 wherein said end plates are inset into said outer surfaces of said panels such that an outer surface of said end plates is substantially flush with an outer surface of a respective panel.

15. The building component of claim 2 wherein said end plates are substantially rectangular in plan.

16. The building component of claim 2 wherein said panels are comprised of expanded polystyrene.

17. A building component comprising first and second high density foam panels each having inner and outer surfaces, top and bottom, and first and second ends, said panels arranged in spaced parallel relationship with their inner surfaces facing each other, and at least two bridging members extending between and through and molded into said panel members, each said bridging member comprising a pair of elongated end plates oriented in the top to bottom direction of said panels and abutting against said outer surfaces of said panels; and, integral with said end plates, at least two web members extending between and rigidly connecting said end plates, said web members oriented in the top to bottom direction of said panels, having a height substantially less than the height of said panels, and offset from each other in the end to end direction of said panels.

18. The building component of claim 17 wherein said web members are offset in the top to bottom direction of said panels.

19. The building component of claim 18 wherein a lower of said web members includes toward each end thereof a reinforcing member extending from a lower edge of said web member to a respective said end plate, and an upper of said web members includes toward each end thereof a reinforcing member extending from an upper edge of said web member to a respective said end plate.

20. The building component of claim 19 wherein said reinforcing members meet said edges outside of said inner surfaces of said panels.

21. The building component of claim 17 wherein each said web member includes at least one reinforcing rib along a surface thereof between said end plates.

22. The building component of claim 17 wherein each said web member includes at least one reinforcing rib along a surface thereof and wherein said bridging member includes at least one reinforcing structure between said web members.

23. The building component of claim 22 wherein said reinforcing structure comprises a rib.

24. The building component of claim 17 wherein said end plates are inset into said outer surfaces of said panels such that an outer surface of said end plates is substantially flush with an outer surface of a respective panel.

25. The building component of claim 17 wherein said end plates extend substantially from top to bottom of said panels.

26. A building component comprising first and second high density foam panels each having inner and outer surfaces, top and bottom, and first and second ends, said panels arranged in spaced parallel relationship with their inner surfaces facing each other, and at least two bridging members extending between and through and molded into said panel members, each said bridging member comprising a pair of elongated end plates oriented in the top to bottom direction of said panels and abutting against said outer surfaces of said panels, said end plates extending substantially from top to bottom of said panels, and at least two web members extending between and integral with said end plates, each said web member oriented in the top to bottom direction of said panels and having a height substantially less than the height of said panels, and said at least two web members offset from one another in the top to bottom and in the first to second side directions of said panels; and wherein a lower of said web members includes toward each end thereof a reinforcing member extending from a lower edge of said web member to a respective said end plate, and an upper of said web members includes toward each end thereof a reinforcing member extending from an upper edge of said web member to a respective said end plate.

27. The building component of claim 26 wherein said reinforcing members meet said edges outside of said inner surfaces of said panels.

28. A building component comprising first and second high density foam panels each having inner and outer surfaces, top and bottom, and first and second ends, said panels arranged in spaced parallel relationship with their inner surfaces facing each other, and at least two plastic bridging members extending between and through and molded into said panel members, each said bridging member comprising a pair of elongated end plates oriented in the top to bottom direction of said panels and abutting against said outer surfaces of said panels, said end plates extending substantially from top to bottom of said panels, and at least one web member extending between and rigidly connected to said end plates, each said web member oriented in the top to bottom direction of said panels and having a height substantially less than the height of said panels, and each said web member including at least one reinforcing rib along a surface thereof and wherein said bridging member includes at least one reinforcing structure between said web members.

29. A building component comprising first and second high density foam panels each having inner and outer surfaces, top and bottom, and first and second ends, said panels arranged in spaced parallel relationship with their inner surfaces facing each other, and at least two bridging members extending between and through and molded into said panel members, each said bridging member comprising a pair of elongated end plates oriented in the top to bottom direction of said panels and abutting against said outer surfaces of said panels; and, integral with said end plates, at least two web members extending between and rigidly connecting said end plates, said web members oriented in the top to bottom direction of said panels, having a height substantially less than the height of said panels, and offset from each other in the end to end and the top to bottom direction of said panels, and wherein a lower of said web members includes toward each end thereof a reinforcing member extending from a lower edge of said web member to a respective said end plate, and an upper of said web members includes toward each end thereof a reinforcing member extending from an upper edge of said web member to a respective said end plate.

30. The building component of claim 29 wherein said reinforcing members meet said edges outside of said inner surfaces of said panels.

31. The building component of claim 29 wherein each said web member includes at least one reinforcing rib along a surface thereof between said end plates.

32. The building component of claim 29 wherein each said web member includes at least one reinforcing rib along a surface thereof and wherein said bridging member includes at least one reinforcing structure between said web members.

33. The building component of claim 32 wherein said reinforcing structure comprises a rib.

* * * * *